US010196196B2

(12) United States Patent
Philipp

(10) Patent No.: US 10,196,196 B2
(45) Date of Patent: Feb. 5, 2019

(54) WATERTIGHT LIQUID DISPENSER WITH SYRINGE-LIKE FUNCTIONS

(71) Applicant: VCXT, LLC, Bellevue, WA (US)

(72) Inventor: Daniel Philipp, Bellevue, WA (US)

(73) Assignee: VCXT, LLC, Bellevue, WA (US)

( * ) Notice: Subject to any disclaimer, the term of this patent is extended or adjusted under 35 U.S.C. 154(b) by 0 days.

(21) Appl. No.: 14/852,394

(22) Filed: Sep. 11, 2015

(65) Prior Publication Data

US 2016/0075499 A1 Mar. 17, 2016

Related U.S. Application Data

(60) Provisional application No. 62/049,102, filed on Sep. 11, 2014.

(51) Int. Cl.
*B65D 83/00* (2006.01)

(52) U.S. Cl.
CPC ..... *B65D 83/0011* (2013.01)

(58) Field of Classification Search
CPC ..... B65D 83/0011; B65D 83/0016; B65D 83/0027; B65D 83/0005
USPC ..... 222/390.386, 386.5; 604/192, 197–199, 604/218, 224–227
See application file for complete search history.

(56) References Cited

U.S. PATENT DOCUMENTS 1,139,758 A 5/1915 Fisenne
1,170,744 A * 2/1916 Fesler ..... F16K 31/05 15/184
1,309,900 A 7/1919 MacCorkell
1,336,390 A * 4/1920 Sargery ..... A46B 11/0027 222/390
1,447,712 A 3/1923 Darley, Jr.
1,923,974 A 8/1933 Hand
2,695,118 A 11/1954 Taylor
2,816,309 A * 12/1957 Goldsmith ..... A45D 34/04 222/151
3,185,345 A 5/1965 Hunegs
4,122,983 A * 10/1978 Jolly ..... A46B 15/0071 222/390
4,144,988 A 3/1979 Bergman
4,277,194 A * 7/1981 Smith ..... A46B 11/0027 222/326
4,753,373 A 6/1988 Seager
5,016,782 A * 5/1991 Pfanstiel ..... A47K 5/1201 222/257
5,066,155 A * 11/1991 English ..... A46B 5/0095 401/175
9,533,103 B2 * 1/2017 Okihara ..... A61M 5/31515
2008/0101850 A1 * 5/2008 Wojcik ..... A45D 34/04 401/265

(Continued)

FOREIGN PATENT DOCUMENTS

EP 1176103 * 1/2002
FR 780947 * 5/1935

*Primary Examiner* — Lien Ngo
(74) *Attorney, Agent, or Firm* — McCoy Russell LLP

(57) ABSTRACT

The present disclosure describes a capped syringe-like device for storing and dispensing liquid, with a movable plunger actuated by a rod inside a fluid dispensing container. The face sharing contact between the fluid dispensing container and the actuated plunger results in leak-proof dispensing of a controlled amount of liquid through a dispensing tip. The device may be used for refilling liquid containing vessels, for example.

6 Claims, 21 Drawing Sheets

(56) References Cited

U.S. PATENT DOCUMENTS

| | | | | |
|---|---|---|---|---|
| 2008/0132851 | A1* | 6/2008 | Shaw | A61M 5/347<br>604/199 |
| 2009/0318880 | A1* | 12/2009 | Janish | A61M 5/31511<br>604/228 |
| 2009/0324321 | A1* | 12/2009 | Nasu | A45D 40/04<br>401/172 |
| 2011/0034882 | A1* | 2/2011 | Quinn | A61M 5/31511<br>604/218 |

* cited by examiner

WATERTIGHT LIQUID DISPENSER WITH SYRINGE-LIKE FUNCTIONS

CROSS-REFERENCE TO RELATED APPLICATIONS

The present application claims priority to U.S. Provisional Patent Application No. 62/049,102 entitled "WATERTIGHT LIQUID DISPENSER WITH SYRINGE-LIKE FUNCTIONS," filed on Sep. 11, 2014, the entire contents of which are hereby incorporated by reference for all purposes.

FIELD OF THE INVENTION

The present description generally relates to liquid dispensing systems and, in one example, to a portable, leakproof device for controlled dispensing of liquids.

BACKGROUND AND SUMMARY

Dispensing syringes and syringe-like devices may be used for storing, mixing, transporting, and dispensing a wide variety of liquids. These devices come in many forms and configurations, including assemblies comprising a barrel having a fluid discharge end, a plunger disposed within said barrel and having a threaded rod extending therefrom for engaging the plunger for advancement relative to the barrel, and a control portion for engaging said threaded rod.

One example of the aforementioned type of dispenser is illustrated in Bergman, U.S. Pat. No. 4,144,988. The patent discloses a device with a piston and lead screw dispenser with a twistable projection. The device includes a dispenser spout at one end and is filled through the opposite end. In one embodiment, the tube and dispensing unit are made of plastic materials and the securement is by ultrasonic welding. When the dispenser tip is opened, rotating the lead screw projection will advance (determine the piston position) and discharge the tube's filling.

Likewise, U.S. Pat. No. 1,447,712 by Darley discloses a dispensing device with a screw that operates the piston via turning the operating cap. The device is filled using the nozzle in the upper shaft and operated by unscrewing the conical cap and turning the operating clockwise motion. When a sufficient quantity of paste has been ejected, the operator then reverses the direction of the operating cap, moving the piston slightly towards the bottom and preventing the paste from leaking.

The inventor herein has recognized problems with syringe-like dispensers of this kind, including issues related to their tendencies to leak, lack of portability, increased assembly complexity, and reduced ability to dispense small and accurate amounts of viscous liquids.

As one example, Bergman's plunger assembly may be prone to leakage of liquids, as compared with more paste-like fillings. Similarly, leakage from the spout during transportation and non-dispensing conditions can be significant. Further still, simple manual assembly without addition tools, such as welders, is unachievable with the described configuration. Further still, the force necessary to rotate the base and generate accurate control of the amount of dispensed liquid can be either too high or too low depending on the degree of compression required to maintain a water-tight seal between the plunger and the wall.

In one example, at least some of the above issues are addressed by a fluid dispensing device including a cylindrical housing including a dispensing tip, a movable plunger disposable in the cylindrical housing, the plunger including at least one protrusion configured to be in face-sharing contact with an inner surface of the cylindrical housing along an entirety of a dispensing path of the plunger, and a displacement element configured to at least partially extend into the dispensing tip.

In this way, the cylindrical housing forms a liquid reservoir for containing a fluid. To dispense the fluid, the plunger is advanced via a suitable actuation mechanism, such as twisting of a twistable base coupled to the plunger. In an example, the plunger includes a silicone cap to form a watertight seal with the inner surface of the housing defining the liquid reservoir. Further, the displacement element may extend and project into an interior space of the dispensing tip of the housing to create an additional flow restriction for dispensing fluid, thus enabling precise control of small liquid amounts while also reducing waste liquid retained in the device at maximum plunger displacement.

In another embodiment, the fluid dispensing device may comprise a housing body with a liquid reservoir and a slidable plunger rod with a plunger top that may be actuated into the housing body such that the plunger top acts as an displacement element and inserts into a dispensing tip of the housing body to dispense fluid from the device. A removable cap may be coupled to the housing body to plug the dispensing tip when fluid is not being dispensed.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
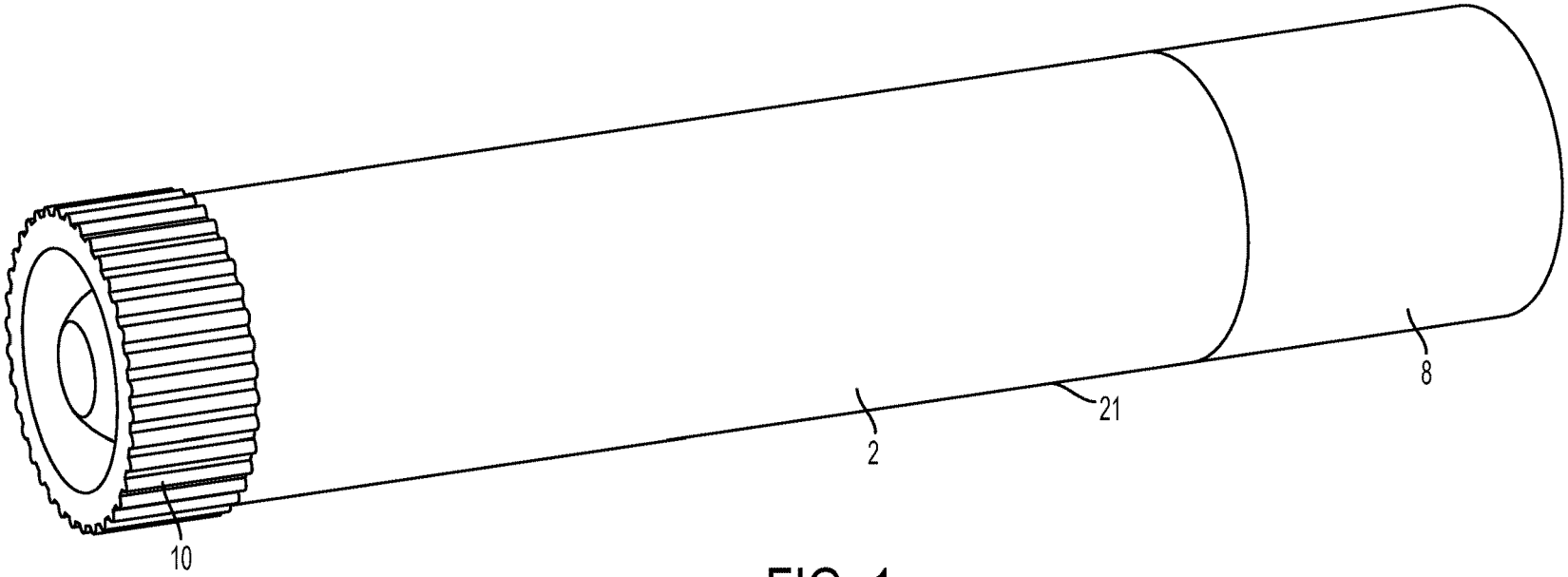
FIG. 1 is a perspective view of the external surfaces of a dispensing device according to an embodiment of the disclosure.

The present application relates to a syringe-like device for easy and effective delivery and ejection of liquids, including viscous fluids such as oils, as well as water-based liquids or various other fluids. The dispensing system may include an outer tubular housing body and an inner liquid reservoir terminating in a dispenser tip having an aperture configured to expel liquid contained in the liquid reservoir. The dispensing system further includes a plunger comprising a silicone element that is receivable within the housing body and having an interior threaded portion. The silicone element is contiguous with a plastic base also having a threaded portion. A threaded rod is disposed within the inner liquid reservoir coaxial with the housing body and attached to a twistable hand wheel, which is configured to attach to the housing body at an end opposite the dispensing tip. The threaded portion of the plunger may be actuated along a length of the threaded rod by rotation of said hand wheel. A removable cap with a stationary plug protrusion located on the center of the inner surface of the cap fits into the aperture of the dispensing tip, serving as a physical plug to prevent liquid leakage when the cap is snapped onto the dispensing tip.

In an example embodiment, the actuating plunger is comprised of a silicone plunger cap attached to a plastic plunger base wherein the silicone plunger cap defines a lower surface of the liquid reservoir and forms a tight seal between the liquid in the reservoir and the plunger.

The centralized threaded rod actuating the axial movement of the plunger may be comprised of a continuous right-handed (or left-handed, if desired) external coarse thread, wherein the thread contains a pitch that is shorter relative to the depth of the thread. This produces a high depth to pitch ratio that enhances interactions and mechanics to enable the plunger silicone cap to move along the threaded rod with appropriate actuation force while forming a leak-proof seal against liquid in the liquid reservoir. Additionally, along with the sizing of the dispensing tip and the multiple restrictions formed by the threaded rod extending into the reservoir volume of the dispensing tip, the specific thread sizing enables precise control of small amounts of potentially highly valuable liquids.

The liquid may exit the dispensing tip when the plunger is advanced through appropriate rotation of the threaded rod (e.g., clockwise) by the twistable hand wheel, wherein the threaded rod extends into the dispensing tip with the further advantage that the plunger may expel substantially all of the liquid in the liquid reservoir, minimizing residual liquid in the reservoir of the housing body. After near-complete expulsion of liquid, the twistable hand wheel can no longer be rotated due the plunger registering with an interfering angular protrusion that prevents further axial advancement. Furthermore, liquid may be drawn into the liquid reservoir by counter-clockwise rotation of the hand twistable portion.

In one embodiment, the fluid dispensing device may comprise a housing body with a liquid reservoir, and a slidable plunger with a plunger top and a plunger base. The slidable plunger may be actuated into the housing body of the dispensing device, such that the plunger top inserts into the dispensing tip of the housing body to dispense fluid from the device. A removable cap may be attached to the dispensing device.

In another embodiment, the housing body with a dispensing tip may have flat face sharing surface which interfaces with a complementary flat surface on a removable cap. The removable cap may have a plug in its inner wall which can plug the dispensing tip when the cap is attached to the housing body, thereby preventing liquid from leaking out and ensuring a secure fit between the housing body and the removable cap. The plunger top may have a complementary dispensing tip insert which inserts into the dispensing tip of the housing body and acts as a displacement element to expel fluid from the dispensing tip.

In this way, a more discrete and compact package may be achieved. Further, in some examples, the assembly may be fully assembled with no welding or screwing necessary, and, therefore, the dispensing device can easily be constructed and utilized by individuals with little to no training.

The embodiment illustrated in FIGS. 1-16 is drawn approximately to scale, although various modifications in the relative sizing of one or more components may be made.

FIG. 1 is a perspective drawing of a dispensing device 1, with a removable cap 8 attached onto a tubular housing body 2, which is adjoined to a twistable hand wheel 10. The housing body 2 and the removable cap 8 may be constructed from a suitable polymer such as plastic, such that the outer surface 21 of device 1 is durable, smooth, hard, and lightweight.

Figure 2:
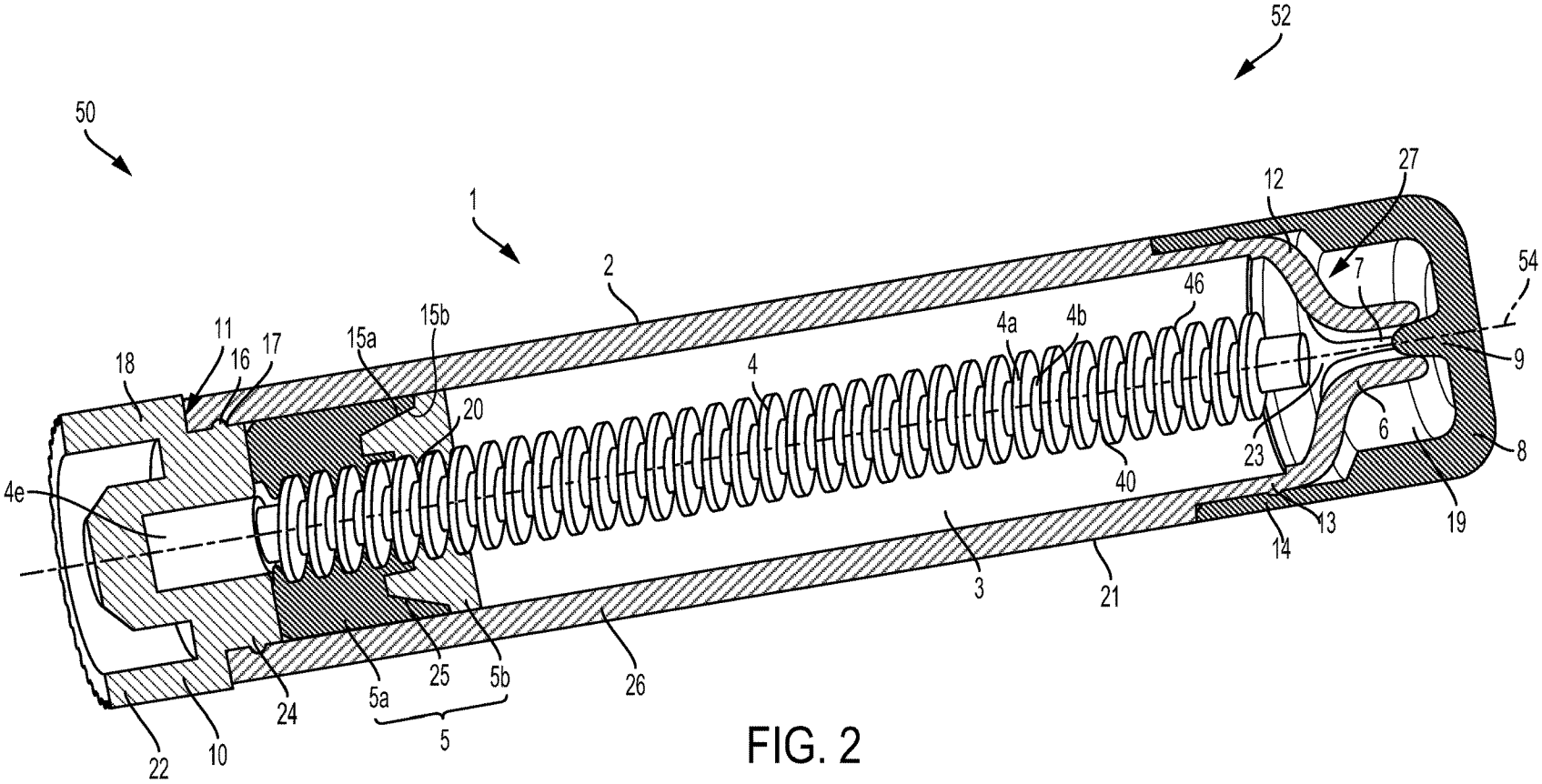
FIG. 2 is a magnified cross-sectional view of the dispensing device of FIG. 1, with a plunger coupled to a central internal threaded rod in the fully extended position and a removable cap with its stationary plug protrusion fitted inside an aperture of the dispensing device.
Figure 3:
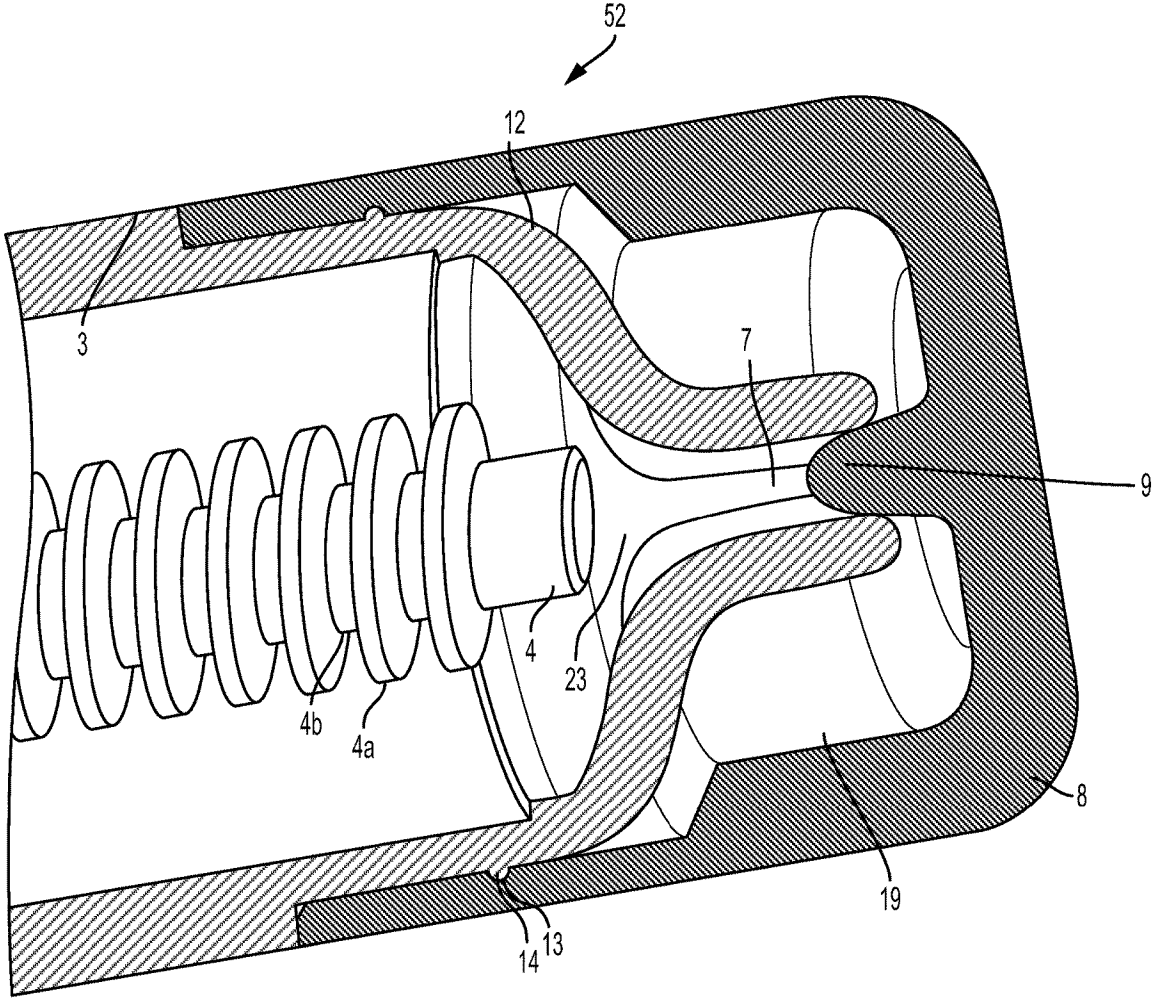
FIG. 3 is a magnified view of an end of the dispensing device of FIGS. 1 and 2 with threaded rod in fully extended position at the second end.
Figure 4:
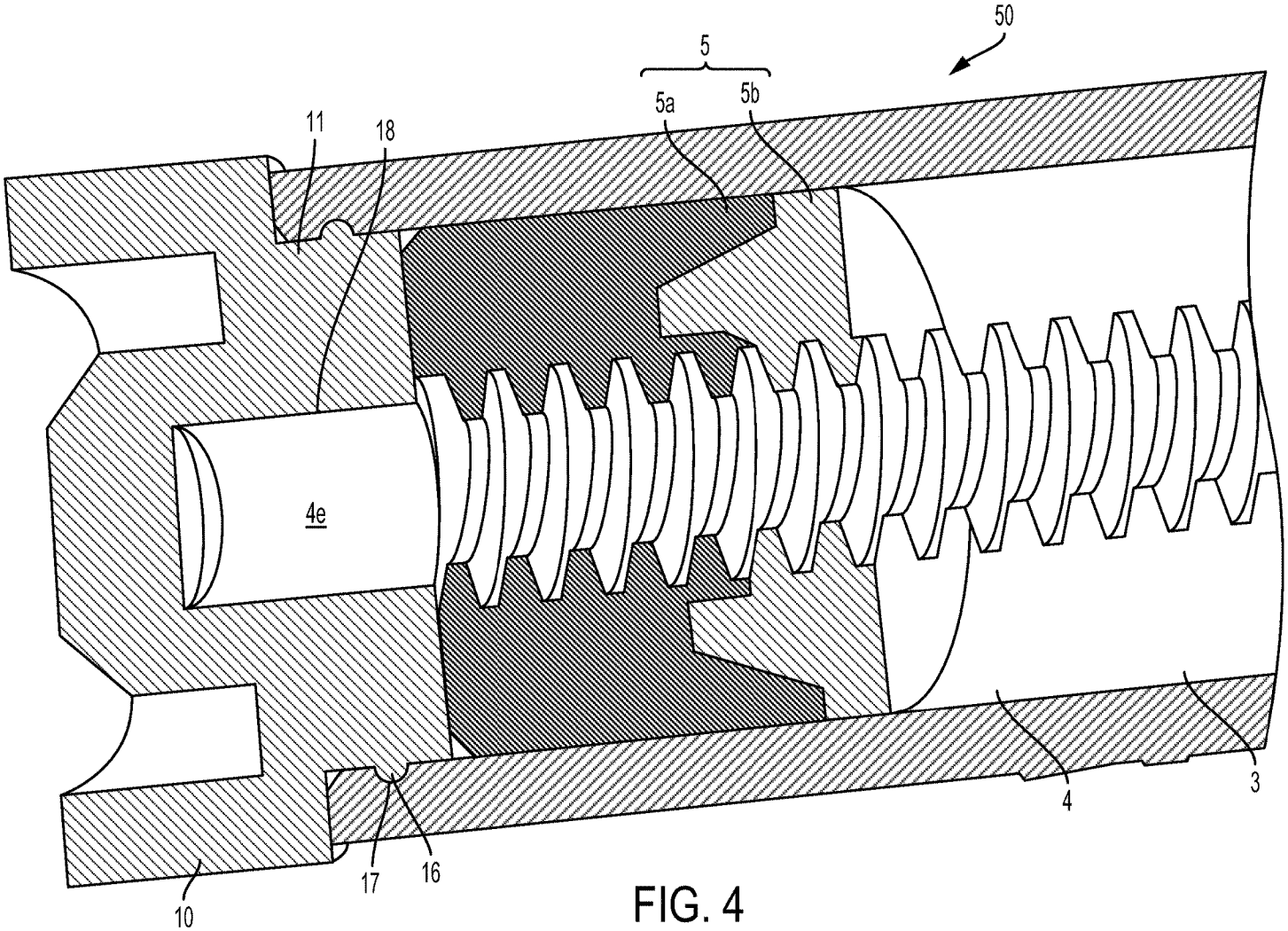
FIG. 4 is a cross-sectional view of the threaded rod of FIGS. 1 and 2 rotated through the plunger and a twistable hand wheel that functions to actuate the rod.

FIGS. 2-4 illustrate the dispensing device 1 in cross-section along its longitudinal axis (axis 54 in FIG. 2). The dispensing device has a first, actuation end 50 and a second, dispensing end 52 opposite the first end 50. FIG. 3 shows a magnified view of the second end 52 while FIG. 4 shows a magnified view of the first end 50.

The main body of dispensing device 1 comprises of the aforementioned tubular housing body 2 and an inner barrel serving as a liquid reservoir 3 having a bottom opening 11 for receiving a plunger 5 mounted on a threaded rod 4. The second end 52 of the dispensing device 1 has a dispensing tip 6. The tubular housing body 2 has a solid wall 26 with a thickness that extends uniformly to a spout area 27 where the wall thickness decreases temporarily before increasing again at the tip 6. Further, the dispensing tip 6 has a discharge aperture 7 at its apex. The removable cap 8 is fitted around the dispensing tip 6 and a stationary plug protrusion 9 in the inner center of the removable cap 8 sits inside the aperture 7 to prevent fluid leakage. The housing body 2 has a concentric notch 13 on its outer surface which interlocks with a groove 14 on the inner wall of the removable cap 8, securing a tight fit between the housing body 2 and the removable cap 8.

As explained above, the first end 50 has a bottom opening 11 for receiving the plunger 5. For engagement of the threaded rod 4 in order to actuate the plunger 5, the twistable hand wheel 10 may be rotated either clockwise or counter-clockwise.

The dispensing tip 6 is indented inward along the housing body's outer surface 21, and forms a conical-shaped tip provided with a neck including the aperture 7, wherein fluid is forcibly dispensed out of the aperture when plunger moves upward via the twistable hand wheel 10 being engaged and twisted.

The twistable hand wheel 10 comprises a hollow cylindrical piece fabricated from plastic or similar material, with an outer hand grip portion 22 projecting away and out from housing body 2, an indented inner piece 24 fitted tightly into the housing body 2 via insertion through the bottom opening 11, and a circular chamber 18 or pocket wherein the threaded rod base **4*e*** is securely inserted into to form a tight but reversibly contiguous attachment.

The plunger 5 has a plunger base **5*a* and a plunger cap 5*b*. In one example, the plunger base 5*a* may be plastic while the plunger cap 5*b* may be made with a polymer material such as silicone, such that the plunger base 5*a* is more rigid than the cap 5*b*. The plunger cap 5*b* is contiguous to and physically bound to the plunger base 5*a* via a suitable fixing mechanism, such as glue, along one face of the plunger base 5*a*. The plunger cap 5*b* and the plunger base 5*a* both have a plurality of complementary, interlocking surfaces 15*a*, 15*b*, each in face sharing contact with one another, that increase the surface area compared to a flat straight surface, and are able to be glued together to produce greater adhesion between the plunger base 5*a* and cap 5*b*, respectively. Further, the angled surfaces 25 of where the plunger base 5*a* and plunger cap 5*b*** are in contact may be used to transfer forces/stresses generated during the rotation and movement of the plunger in a way to reduce forces tending to separate the two surfaces from one another, such as radial stresses and forces.

The top of threaded rod 4 acts as a displacement element when the threaded rod 4 is closest to the second end 52 in a fully extended position (shown in FIGS. 2 and 3). The top of the threaded rod 4 extends into reservoir space 23 near the dispensing tip 6 so that the top of the threaded rod 4 acts as an displacement element to expel substantially all of the liquid in the liquid reservoir, minimizing residual liquid in the reservoir 3 of the housing body. The second end 52 of the housing body 2 near the dispensing tip 6 has angular end stop protrusions 12 along its inner wall at a transition area before the conical dispensing tip 6 forms, forming the reservoir 23 between the protrusions 12 and the aperture 7. When the plunger is moved to its fully extended position (e.g., the hand wheel is twisted and the plunger extends along the full length of the threaded rod), the rod 4 and plunger 5 interface with protrusion 12 with the rod threads **4*a* fully engaged along the entire inner (threaded) region of the plunger base 5*a* and cap 5*b*. After registering at the stop protrusions 12, the plunger 5 can no longer advance along the threaded rod 4 via the rotation of the twistable hand wheel 10. At its opposite end, the threaded rod 4 may have a cylindrical and smooth screw rod base 4*e* extending from the threaded rod 4, wherein the rod base 4*e* is contiguous and reversibly attachable to the twistable hand wheel 10**.

The plunger 5 includes a tubular channel 20 with a plurality of thread grooves, which may be formed as teeth, complementary to the rod thread **4*a*, and serve as a threaded bearing that engages the threaded rod 4. The rod 4 is threaded continuously and uniformly through both cap 5*b* and base 5*a*, so that the rod 4 may be guided through the plunger 5 via said threaded bearing to form an interlaced and secure attachment. The face of the silicone plunger cap 5*b* opposite the face glued to the plunger base 5*a* is adjacent to and defines a bottom surface of the liquid reservoir 3 and forms a tight seal between the liquid in the reservoir 3 and the plunger 5, so that no liquid may leak out. The cap 5*b* also forms a seal with the threads so liquid does not leak back through threads and out the bottom past the hand wheel (which may not be a water-tight seal). The surface of the outer circumference of the cylindrical plunger 5 (excluding the flat faces proximal and distal to the liquid reservoir 3) is contiguous to the inner wall of the housing body when it is stationary and/or being actuated along the threaded rod 4**.

The device has a removable cap 8, comprising a smooth plastic cylindrical covering that is uniformly thinner in the area that is physically in contact with and adjacent to the housing body 2 and uniformly thicker in the area adjacent to a hollow space 19 formed when the cap 8 is attached, and the conical-shaped stationary plug protrusion 9 located on the center of the inner surface of the cap 8. When the removable cap 8 is snapped onto the housing body 2, the plug protrusion 9 fits into the aperture 7 of the dispensing tip 6, serving as a physical plug to prevent liquid leakage. The second end of the housing body 2, near the dispensing tip 6, includes a concentric notch 14 along its external surface, to which the removable cap 8, having a complementary interlocking concentric groove 13, can be snapped onto the housing body 2 to protect unwanted liquid expulsion from the aperture 7. Device 1 is closed when the removable cap 8 is attached and open when the removable cap 8 is not attached.

Figure 5:
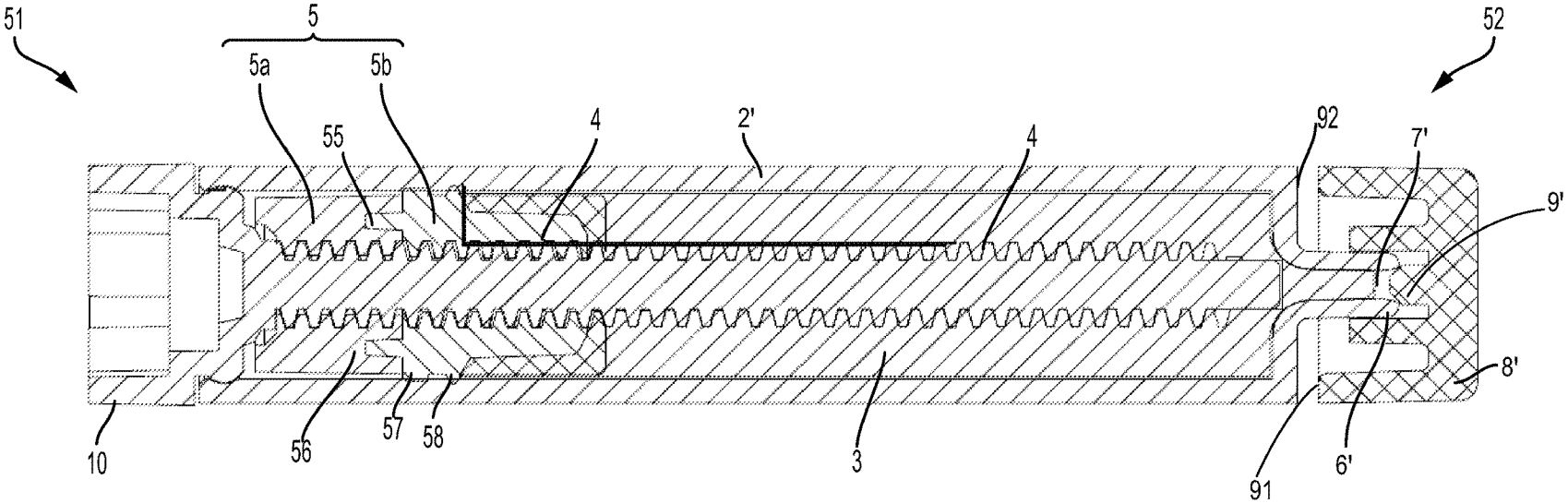
FIG. 5 is a cross sectional view of an additional embodiment of the dispensing device with a removable cap attached and the central threaded rod inserted inside a plunger which is situated at a first end of the housing body.

FIG. 5 shows the dispensing device with an alternate embodiment of a housing body 2' and a removable cap 8' attached to the dispensing end 52 of the dispensing device. Rather than having a tapered region from the outer surface of the housing body toward the dispensing tip, housing body 2' includes a flat surface angled at 90° relative to the outer surface of the housing body, where the flat surface is coupled to a dispensing tip 6' a dispensing aperture 7'. Additional elements of the dispensing device are similar as the embodiment described above with respect to FIG. 2, and thus the same reference numbers refer to the same parts.

As shown in FIG. 5, the plunger is in a position situated closer to the twistable handle wheel 10 at the first end 50 of the device, away from the dispensing tip 6' and the dispensing aperture 7', thereby defining a first, larger volume of the liquid reservoir 3. To prevent liquid from leaking out of the liquid reservoir, multiple interlocking surfaces may be created between the plunger base and the plunger cap and also between the plunger and the housing body 2'. In one such example shown in FIGS. 5 and 6A, plurality of interlocking grooves and protrusions, securing a tight fit between the plunger base 5*a* and the plunger cap 5*b* are illustrated. For example, the plastic plunger base 5*a* may have a groove 56 which complementarily fits with a protrusion 55 on the plunger cap 5*b*. In other embodiments of the device, the angular disposition of the groove(s) and protrusion(s) may be of any desired orientation, as long as the contact sharing surfaces between them interlock securely. As the plunger moves along the longitudinal axis of the dispensing device 1, a tight leak-proof fit between the plunger 5 and the inner wall of the housing body 2' may be created by protrusions 57 and 58 of the plunger cap 5*b* which are in face-sharing contact with the inner surface of the housing to prevent fluid from leaking out from the fluid reservoir 3 and seeping in between the contact sharing surfaces of the plunger 5 and the housing body 2'.

The removable cap 8' includes a conical-shaped stationary plug protrusion 9' located on the center of the inner surface of the cap 8'. When the removable cap 8' is snapped onto the housing body 2', the plug protrusion 9' fits into the aperture 7' of the dispensing tip 6', serving as a physical plug to prevent liquid leakage. The second end of the housing body 2', near the dispensing tip 6', has a flat surface 92 interfacing with a complementary flat surface 91 on the removable cap 8', ensuring a tight fit between the removable cap 8' and the housing body 2' to protect unwanted liquid expulsion from the aperture 7. The dispensing device is closed when the removable cap 8' is attached and open when the removable cap 8' is not attached.

When the dispensing device is open, rotation or twisting of the twistable hand wheel 10 in a clockwise direction will advance the plunger 5 along the threaded rod 4. The plunger acts as a piston causing the liquid in the housing body that is contained between the plunger 5 and the dispensing tip 6 to be discharged, until movement of the plunger is stopped by angular protrusion 12, at which point no more liquid may be dispensed. Rotating the twistable hand wheel 10 counterclockwise will cause the plunger 5 to retreat along the threaded rod 4 and create a suctioning effect wherein fluid or air near or in physical contact with the dispensing tip may be drawn into the liquid reservoir 3.

Figure 6A:
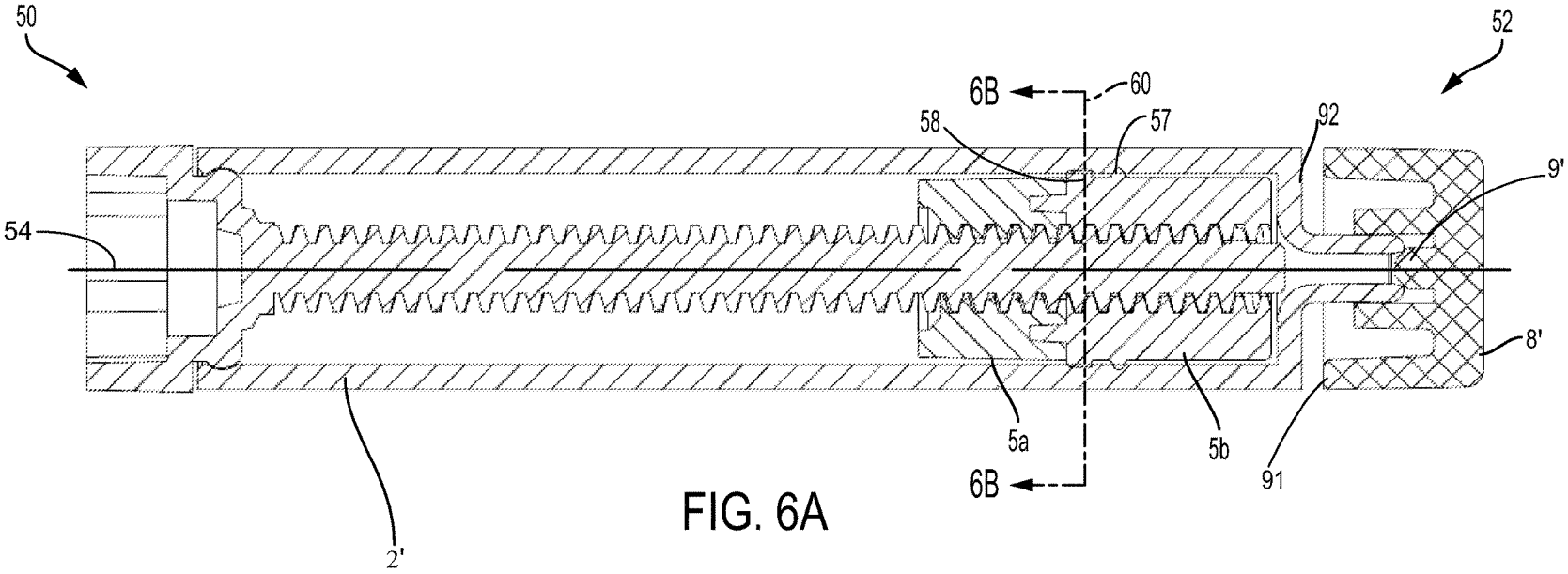
FIG. 6A shows a cross-sectional view of the device of FIG. 5 with the threaded rod inserted into the plunger which is situated at a second end of the device.
Figure 6B:
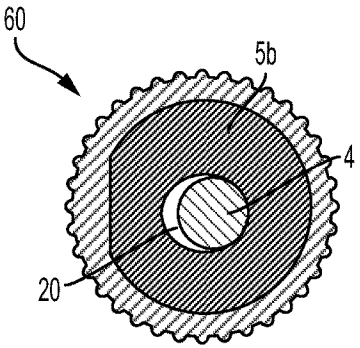
FIG. 6B is a cross-section of the plunger cap with the threaded rod passing through its tubular core.

The apposition of plunger cap 5*b* with threaded rod 4 housed inside the cylindrical cavity is also shown in a cross section view 60 in FIG. 6B, taken along section 6B-6B of FIG. 6A.

An embodiment of the housing body 2 of the dispensing device 1 is illustrated in FIGS. 5, 6A, 7A and 7B, wherein the wall of the housing body 2' has a flat surface 92, perpendicular to the longitudinal axis of the device. The flat surface 92 is adjoining to the dispensing tip 6' with the dispensing aperture 7' for dispensing the liquid stored in liquid reservoir 3.

Figure 7A:
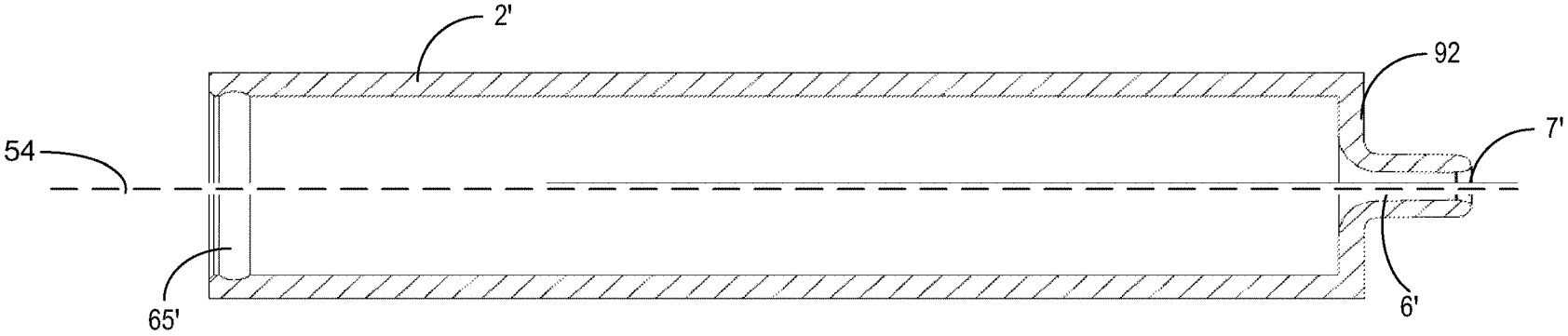
FIG. 7A is a schematic drawing of an embodiment of the housing body with a dispensing tip at its second end.
Figure 7B:
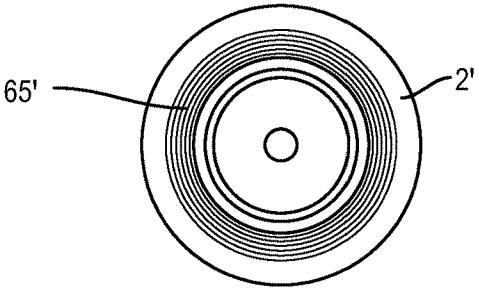
FIG. 7B is a schematic of the bottom of the first end of the housing body.

To secure a tight fit between the interlocking parts of the device, the housing body 2' may have a plurality of threaded grooves to engage multiple parts of the dispensing device 1. In one embodiment shown in FIGS. 7A and 7B, concentric grooves 65' at the distal base of the housing body 2', contiguously and reversibly engage twistable hand wheel 10 to ensure tight interlocking fit. FIG. 7A shows the housing body in cross-section along the longitudinal axis, without the rod 4 or plunger 5 inserted into the housing body. FIG. 7B shows a view down the housing body 2' from the first end towards the second end.

Figure 8:
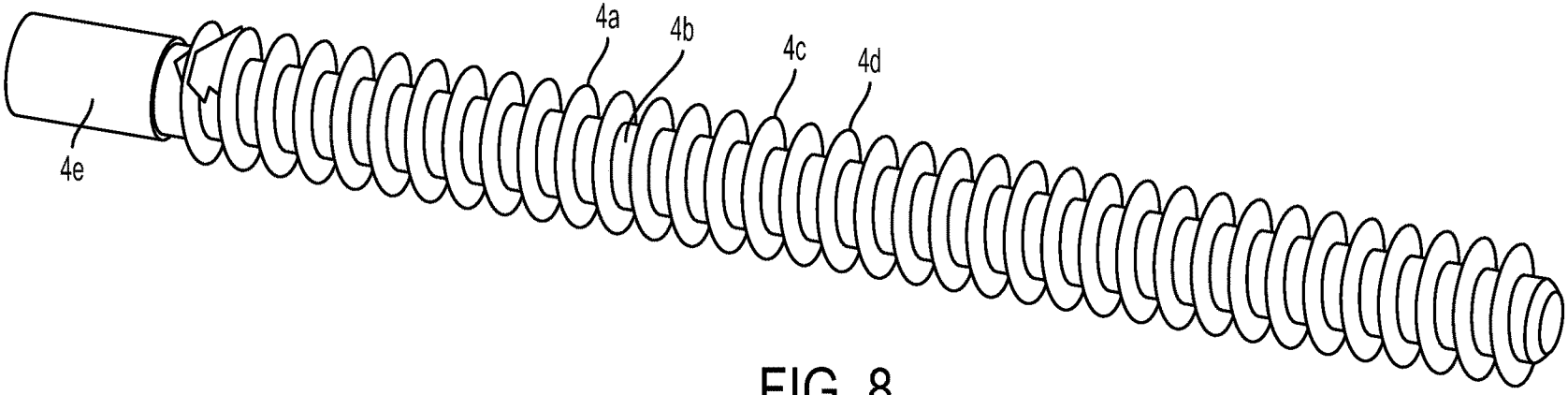
FIG. 8 is a perspective view of the threaded rod having a singular helical thread and a base.
Figure 9:
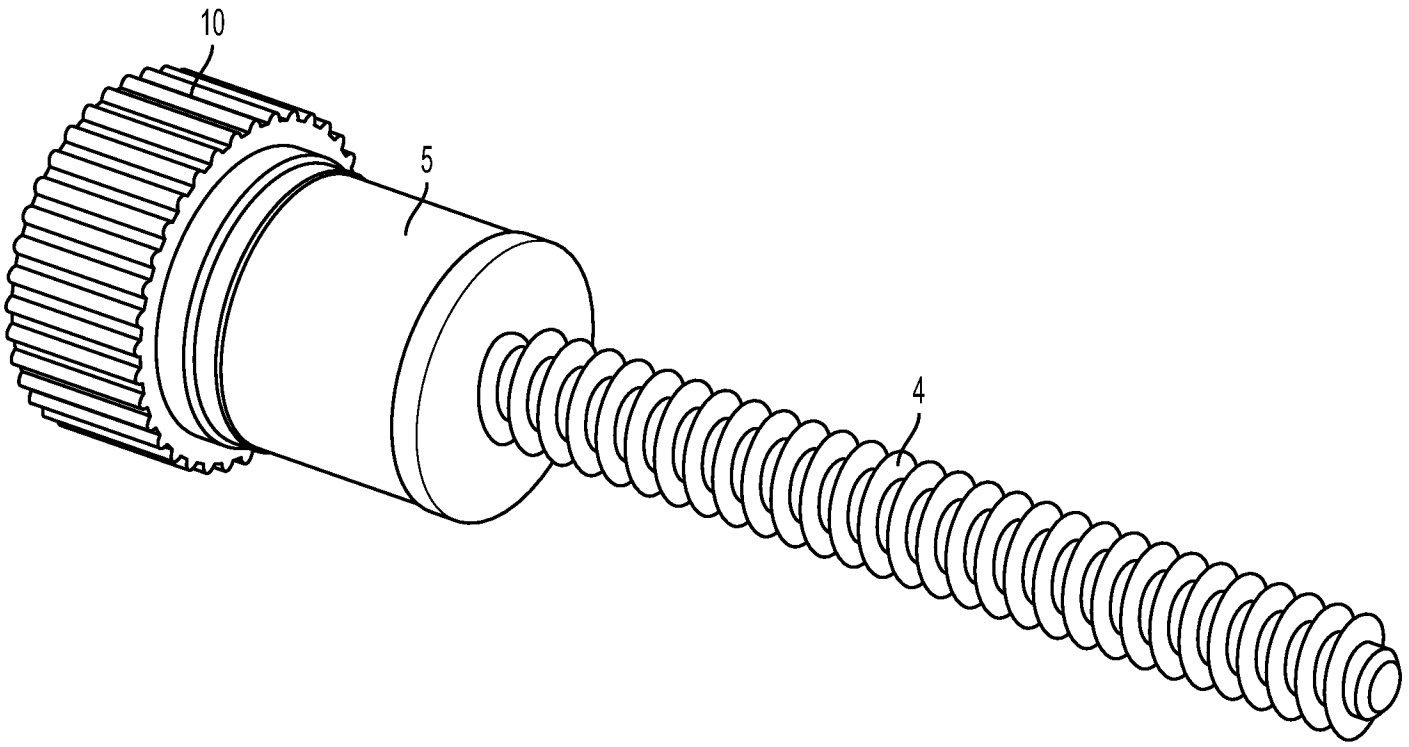
FIG. 9 is a perspective view of the threaded rod inserted into a plunger and attached to a twistable handle.

FIG. 8-11 show the threaded rod 4 which may comprise a single right-handed external coarse screw rod thread 4*a* wound around a root 4*b* of the rod (e.g., central shaft of the rod). The thread 4*a* may include two diametrically opposed, helical flattened surfaces 4*c* that spirally extend along an axial length of said rod 4. The thread of central threaded rod 4 has a pitch p defined as the longitudinal distance from the crest c on one ridge 4*d* to the crest c on an adjacent ridge 4*d* of the thread 4*a* and a depth d defined as the distance from the root of the rod 4*b* to a crest c, wherein the pitch may be shorter relative to the depth of the thread, as shown in FIG. 8. The high d to p ratio produces desired interactions and mechanics that enable the mounted silicone cap 5*b* of the plunger 5 to move along threaded rod 4 and form a leak-proof seal against liquid spillage from the liquid reservoir 3. For example, the specific relative sizing, position, and ratios of lengths and widths can be particularly advantageous for engaging a plunger formed of two different materials having different sealing properties, and different stiffness so that sufficient structural rigidity is achieved while at the same time enabling smooth operation and water-tight seals to be achieved.

Figure 10A:
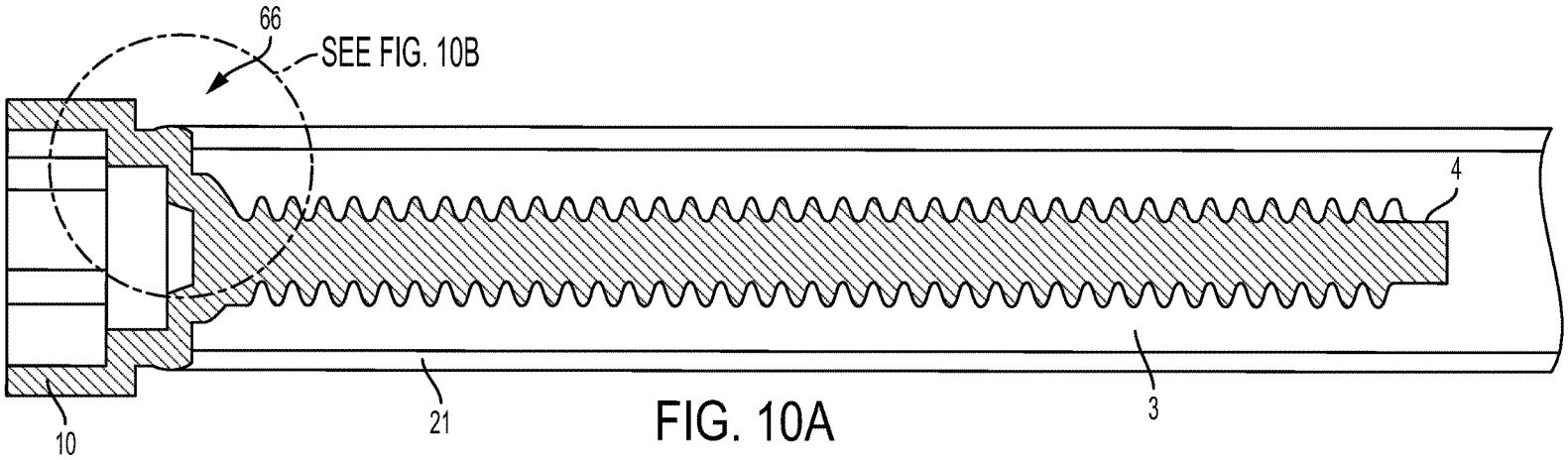
FIGS. 10A and 10B are schematic drawings of the threaded rod attached to the twistable hand wheel.
Figure 10B:
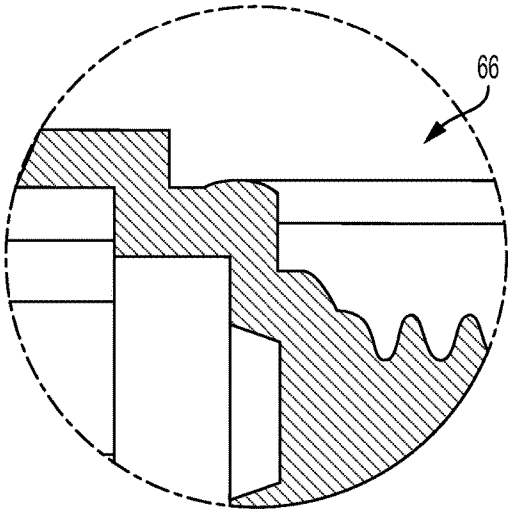
Figure 11:
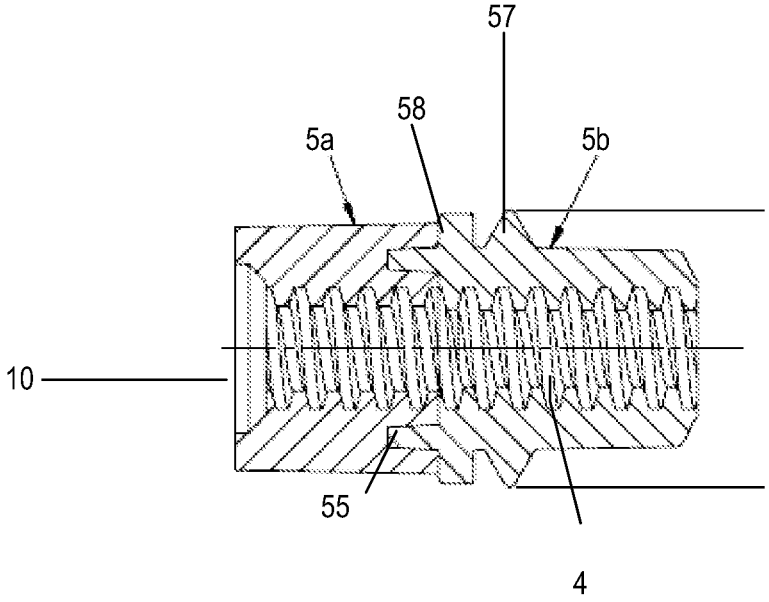
FIG. 11 shows an embodiment of the plunger base and plunger cap with a threaded rod passing through its core.
Figure 12:
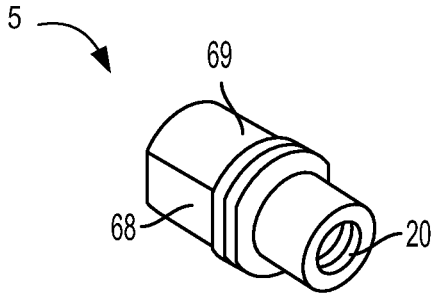
FIG. 12 shows a perspective view of the plunger consisting of a base and a top.
Figure 13:
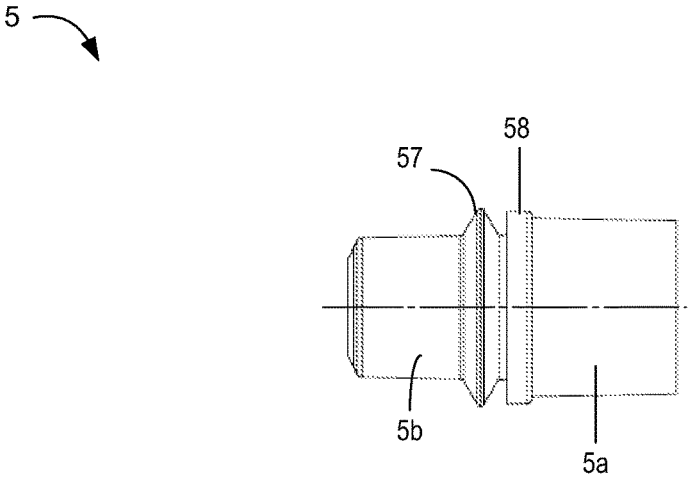
FIG. 13 is a schematic drawing of the cylindrical surface of the plunger.
Figure 14:
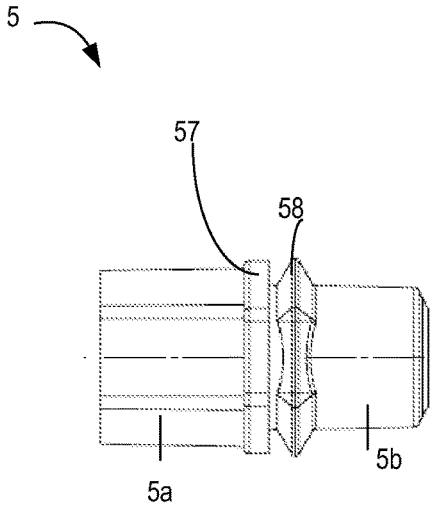
FIG. 14 is a schematic drawing of the planar surface of the plunger.

A magnified schematic of the threaded rod inside the plunger shown in FIG. 10, illustrates that the threaded rod 4 may have a plurality of threads which may be of uniform width and may be angled in relation to the central longitudinal axis of the threaded rod 4, allowing for movement of the plunger along the threaded rod when inserted in the housing body 2 or housing body 2'. The threaded rod 4 is affixed to the twistable hand wheel 10. The rod 4, hand wheel 10 and plunger 5 maybe inserted into the housing body as a unit. Turning the hand wheel in clockwise direction will move the plunger 5 on the threaded rod 4 towards the second end 52 of the device and turning the hand wheel 10 anticlockwise will move them towards the first end 50 of the device, thereby decreasing or increasing the volume of the liquid reservoir 3.

In order to enhance hand grip to maximize ease of twisting motion, the twistable hand wheel 10 may be comprised of a plurality of linear parallel ridges on the hand grip portion 22, each extending parallel along the body of the twistable hand wheel 10. At the junction of the threaded rod 4 and the twistable hand wheel 10, there may be a step protrusion 66 which in apposition with the concentric grooves 65 on the housing body 2 (or with the concentric grooves 65' on the housing body 2') can regulate the range of movement of the twistable hand wheel 10 into the housing body 2. A magnified view of the step protrusion is shown in FIG. 10.

In another example, an O-ring may be used to create a seal between the bottom of the plunger base 5*a*, (face not glued to the cap 5*b*) and the twistable hand wheel 10, wherein the O-ring may be placed in a concentric groove along the inner wall of the housing body 2 or housing body 2', sitting adjacent and contiguous to the twistable hand wheel 10. In another example, a seal may be formed without the use of an O-ring. The twistable hand wheel 10 is adjoined to housing body 2 by a small concentric groove 17 that is located along the internal circumference of the housing body 2 at the opening of the first end (shown in FIGS. 2 and 4), wherein the twistable hand wheel 10 may be snapped into via a small complementary concentric notch 16 along its external circumference, so that the outer surface of the indented inner piece 24 is attached contiguously to the inner surface of the housing body 2.

In one embodiment to assemble the device, the plunger 5 (plastic plunger base 5*a* and silicone plunger cap 5*b* glued together) is coupled to (e.g., twisted) onto the threaded rod 4, so that the bottom edge of the plastic plunger base 5*a* (e.g., the surface opposite the surface coupled to the silicone cap 5*b*) is flush with the base edge of the threaded rod base 4*e*, so as to maximize the volume of liquid able to be filled into the housing body 2. The combined plunger 5 and threaded rod 4 assembly is then inserted into the housing body 2, with the plunger 5 and threaded rod base end 4*e* located at the first end of the housing body 2 and the top end of the threaded rod located at the second, dispensing tip 6 end of the device. The twistable hand wheel 10 is then snapped into the distal end of the device 1, wherein the threaded rod base 4*e* fits (e.g., press-fit) into the hollow chamber 18 of the twistable hand wheel 10 so that they rotate together and are affixed to one another. Alternatively, the twistable hand wheel 10, plunger 5 and threaded rod 4 may be assembled together and then inserted into liquid housing body 2.

In one example, no welding of any kind is required to assemble the dispensing device 1 which maximizes ease and simplicity in assembling, disassembling and cleaning. However, welding may be used, if desired.

In practice, the device can sit flat onto a bottom surface of the twistable hand wheel 10 and liquid can then be delivered by a compatible vertically-dispensing device into the liquid reservoir 3 via entry through the aperture 7 of the dispensing tip 6. After filling, the device 1 can be secured for transport by snapping on the removable cap 8.

Figure 15:
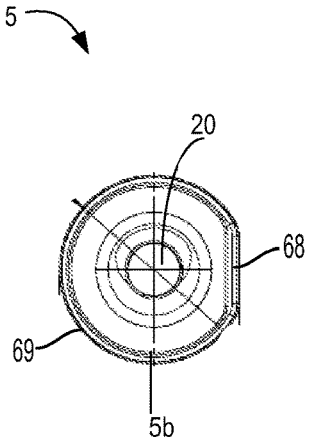
FIG. 15 is a schematic of the bottom view of the plunger.

In an embodiment of the plunger illustrated in FIGS. 12-15, the plunger base 5*a* and plunger cap 5*b* may each have a planar surface 68 and a remaining cylindrical surface 69. Angular protrusions 58 and 57 are radially arranged around the circumference of the plunger cap 5*a* which secure a tight fit between the contact sharing surface of the housing body 2 and the plunger cap 5*b*, to prevent liquid leakage. For example, the protrusions may be in face-sharing contact with an inner surface of the cylindrical housing along an entirety of a dispensing path of the plunger, where the dispensing path of the plunger comprises the range of positions the plunger is configured to travel while disposed in the dispensing device. FIG. 15 shows a schematic view of the tubular channel 20 present in the core of the plunger 5 for housing the threaded rod 4.

Figure 16A:
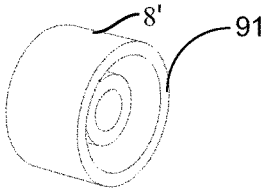
FIG. 16A is a perspective view of the removable cap.
Figure 16B:
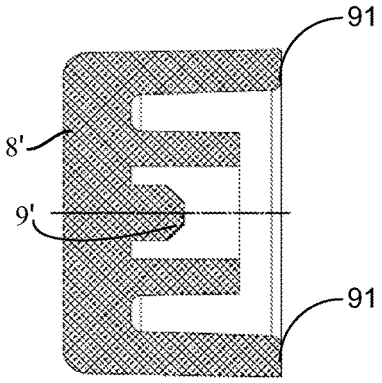
FIG. 16B shows a schematic drawing of an embodiment of the removable cap.

An embodiment of the removable cap is shown in FIGS. 16A and 16B, where the removable cap 8' has a flat surface interfacing with surfaces on the housing body 2'. For example, the flat surface 91 on the removable cap 8' is in apposition with the flat surface 92 on the housing body 2'.

Figure 17:
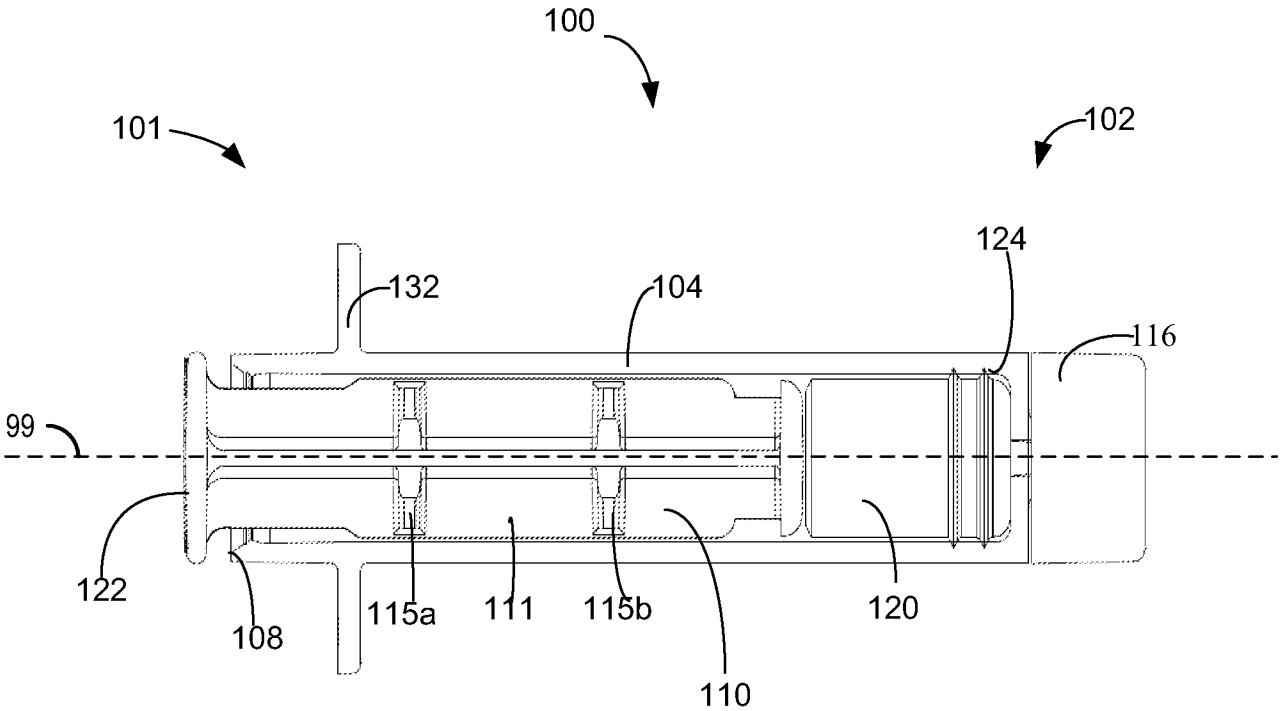
FIG. 17 is a perspective view of an embodiment of a dispensing device with a slidable plunger in a fully extended position when actuated in a housing body with a removable cap.
Figure 18:
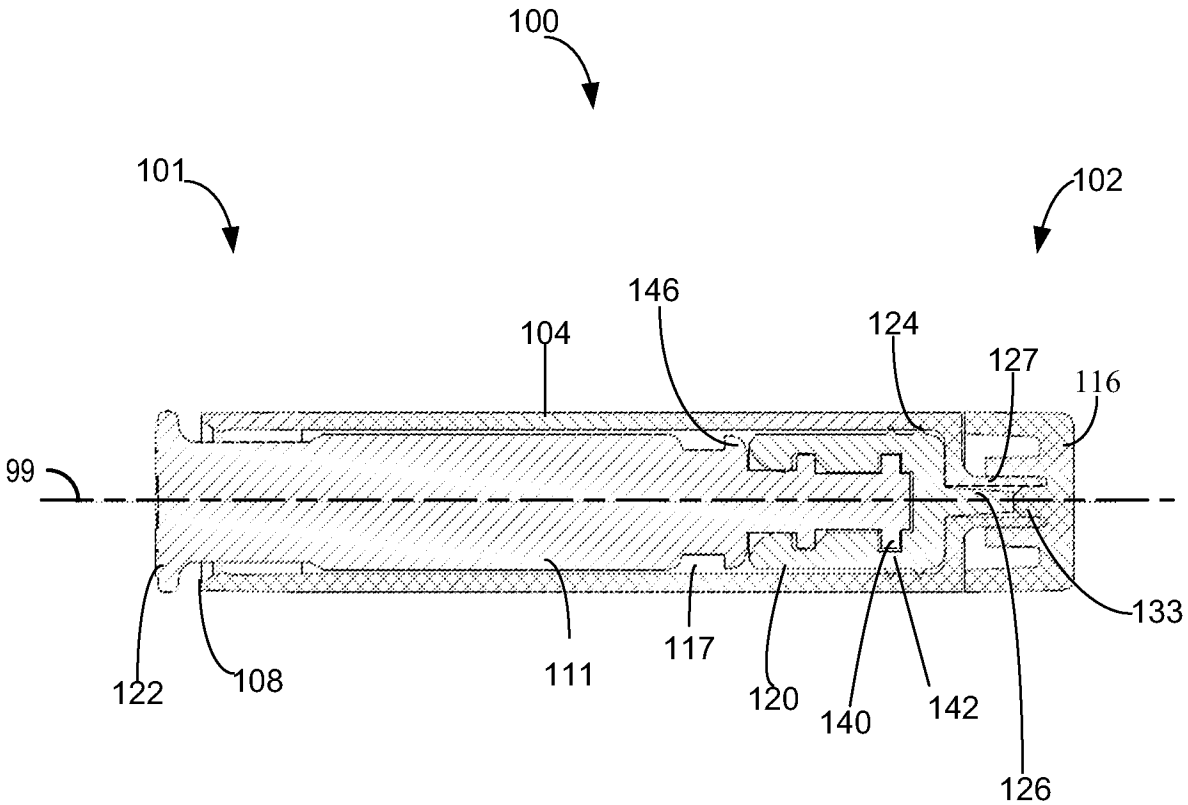
FIG. 18 is a cross sectional view of the dispensing device of FIG. 17.

In another embodiment, a fluid dispensing device with a housing body and a removable cap may be coupled with a slidable plunger to dispense fluid from the device. FIGS. 17-24C illustrate an embodiment of a syringe like liquid dispensing device 100 with a slidable plunger and a removable cap. FIGS. 17-24C are drawn approximately to scale. FIGS. 17 and 18 show the liquid dispensing device 100 with a first, actuation end 101 and a second, dispensing end 102, opposite the first end 101. The dispensing device 100 comprises of a tubular housing body 104 with a liquid reservoir 117, a slidable plunger 110, and a removable cap 116. The removable cap 116 is similar in shape and configuration to the removable cap 8' described above. However, in some embodiments, the removable cap 116 may be similar in shape and configuration to removable cap 8, and thus the housing body 104 may include similar corresponding features to the housing body 2 of FIG. 2. The housing body 104 has a bottom opening 108 for accommodating the slidable plunger 110. The slidable plunger 110 includes a plunger rod 111, a removable plunger top 120, and a plunger base 122. The second end 102 of the dispensing device 100 has a removable cap 116.

The plunger 110 inserts into the bottom opening 108 of the tubular housing 104, such that the removable plunger top 120 inserts first, oriented towards the dispensing second end 102 of the housing body 104 and the plunger base 122 is at the actuation end 101. The removable plunger top 120 may have a plurality of annular grooves and ridges 124, to secure the plunger inside the housing body and to prevent fluid leakage. The plunger rod 111 may have a plurality of longitudinal ridges 113 along its longitudinal axis 99. The plunger rod may also have plurality of radially arranged tab protrusions 115*a* and 115*b* to provide structural rigidity and support to the plunger rod 111 during the sliding action of the plunger 110 into the housing body 104. The plunger base 122 extends out of the housing body 104 when the slidable plunger 110 is completely engaged in the housing body 104 (shown in FIGS. 17 and 18). The plunger base 122 defines a finger engagement surface for operating the dispensing device 100. The outer circumference of the housing body 104 has a flange 132 situated at the actuation end 101 for providing user grip while operating the device 100.

Figure 19:
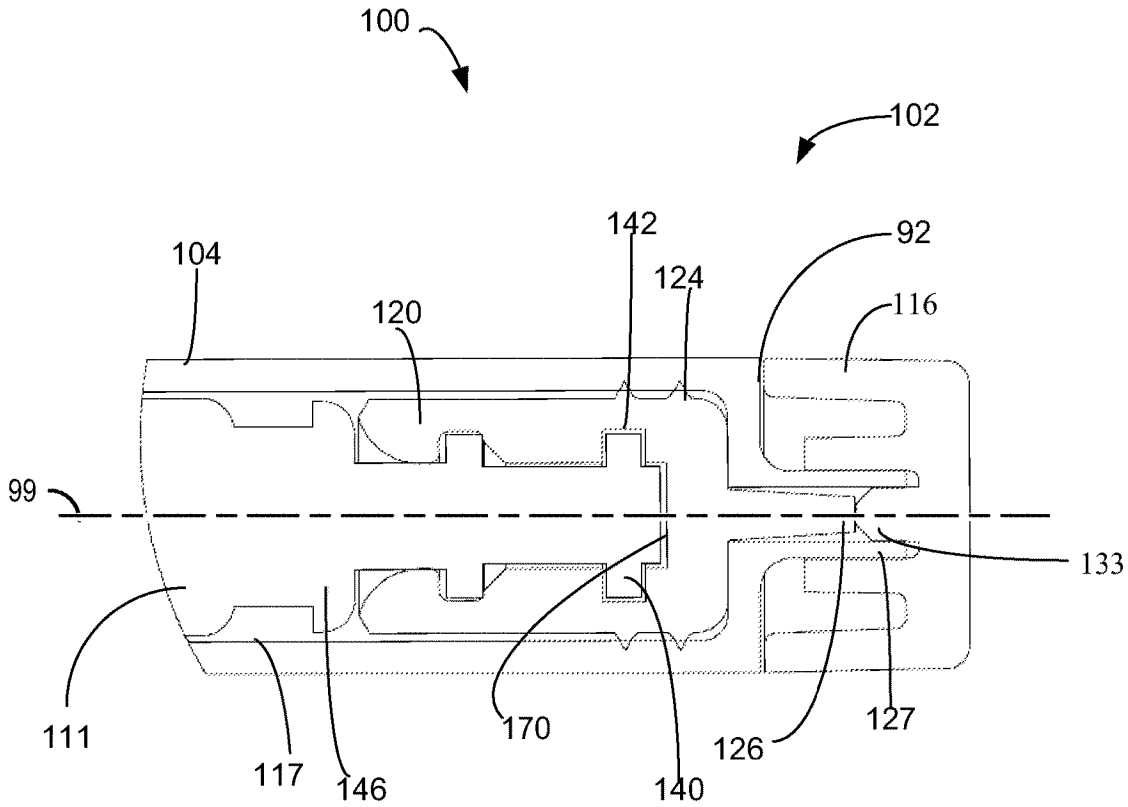
FIG. 19 is a magnified cross sectional view of the dispensing end of the device of FIG. 17 with the plunger fully extended.

The plunger rod 111 inserts into the plunger top 120 and secure interlocking is established by surface to surface contact of complementary surfaces. A plurality of complementary groove(s) and protrusion(s) between the contacting surfaces of the plunger rod 111 and the plunger top 120 secure the plunger rod and plunger top together and prevent liquid from leaking through the adjoining surfaces. As shown in FIGS. 18 and 19, groove 142 on the plunger top 120 may have a complementary fit with protrusion 140 on the plunger rod 111. As the plunger moves along the longitudinal axis 99 of the dispensing device 100, a tight leak-proof fit between the plunger rod 110 and the plunger top 120 is created by protrusions 140 and groove 142 which are in face-sharing contact, thus preventing liquid from leaking out from the fluid reservoir 117. For example, one or more of protrusions 140 may be in face-sharing contact with an inner surface of the cylindrical housing along an entirety of a dispensing path of the plunger. Protrusion 146 on the plunger rod 111 is also in apposition with the plunger top 120, ensuring a secure fit. The angular disposition of the groove(s) and protrusion(s) may be of any desired orientation, as long as the contact sharing surfaces between the respective grooves and protrusions interlock securely. A plunger rod tip 170 interfaces with the plunger top 120 to secure a tight fit between the plunger rod and the plunger top, as shown in FIG. 19.

A plurality of grooves and ridges 124 on the plunger top 120 interface with the housing body 104 inner wall to ensure a secure, leak-proof fit of the plunger top 120 inside the housing body 104. The interlocking of the grooves and ridges 124 with the housing body inner wall ensure that no liquid leaks from the liquid reservoir 117 past the plunger top when the plunger 110 is slidebaly actuated through the housing body 104 towards the dispensing end second position 120.

Figure 20:
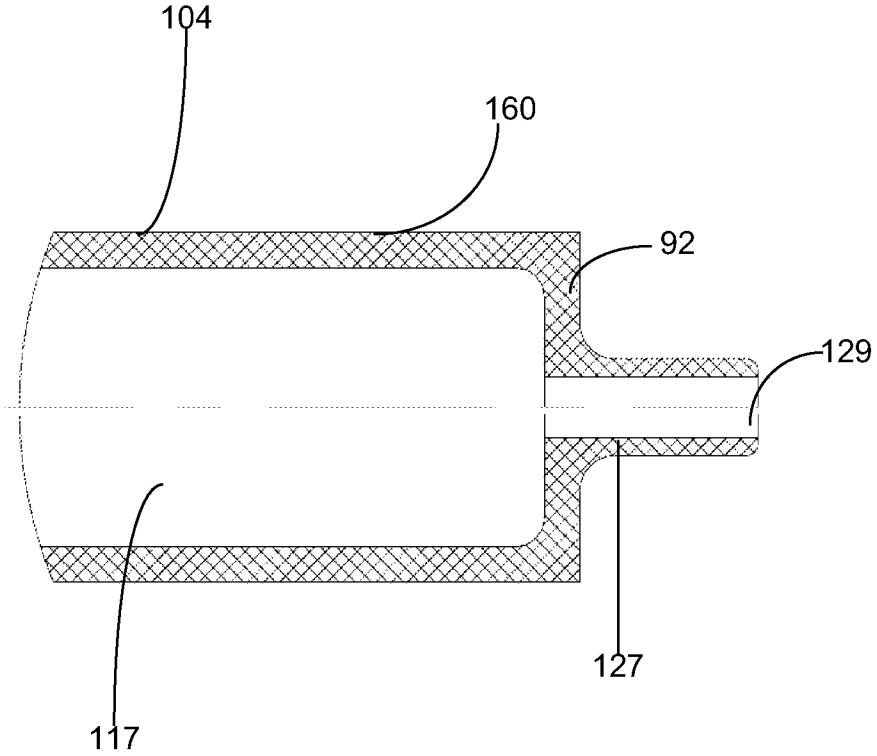
FIG. 20 shows a magnified view of an end of the housing body of dispensing device of FIG. 17.

FIGS. 18-20 show the housing body 104 with a dispensing tip 127 and a dispensing aperture 129 at the dispensing end 102. The dispensing tip 127 has an aperture 129, wherein fluid is forcibly dispensed out of the aperture when plunger 110 slides inside the housing body 104, towards the second end 102, and is in a fully extended position. A dispensing tip insert 126 on the plunger top 120 acts as a displacement element which inserts into the dispensing tip 127 of the housing body, forcing maximum possible volume of fluid out of the dispensing aperture 129.

A magnified cross sectional view of the dispensing end 102 of the device 100 with the removable cap 116 attached is shown in FIG. 19. When the removable cap 116 is attached on the second end of the device, a dispensing aperture plug 133, present on the inner surface of the removable cap 116, inserts into the dispensing aperture 129 and serves as a physical plug to prevent liquid leakage. The second end 102 of the housing body 104 has a flat interfacing surface 91, adjoining the dispensing tip 204. When the removable cap 116 is attached to the housing body 104, the flat surface 91 on the removable cap 116 interfaces with the flat surface 92 on the housing body 104.

Figure 21:
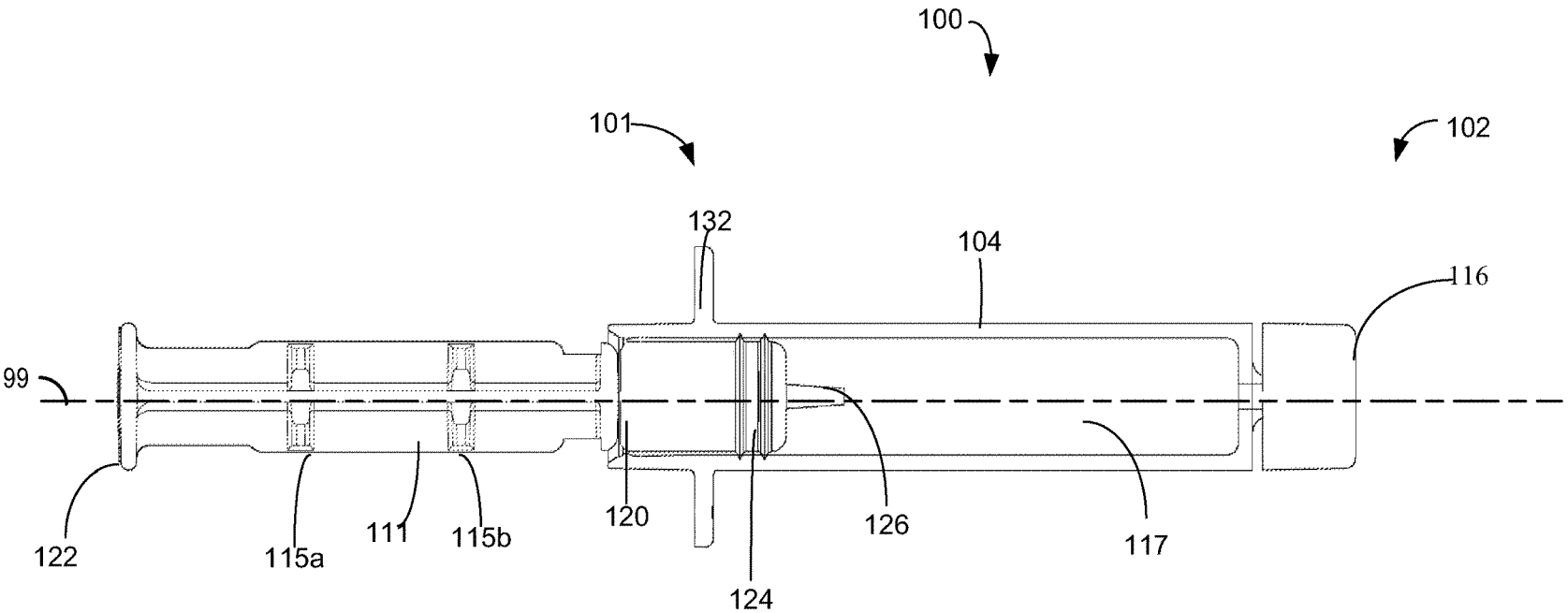
FIG. 21 shows a perspective view of the device of FIG. 17.
Figure 22:
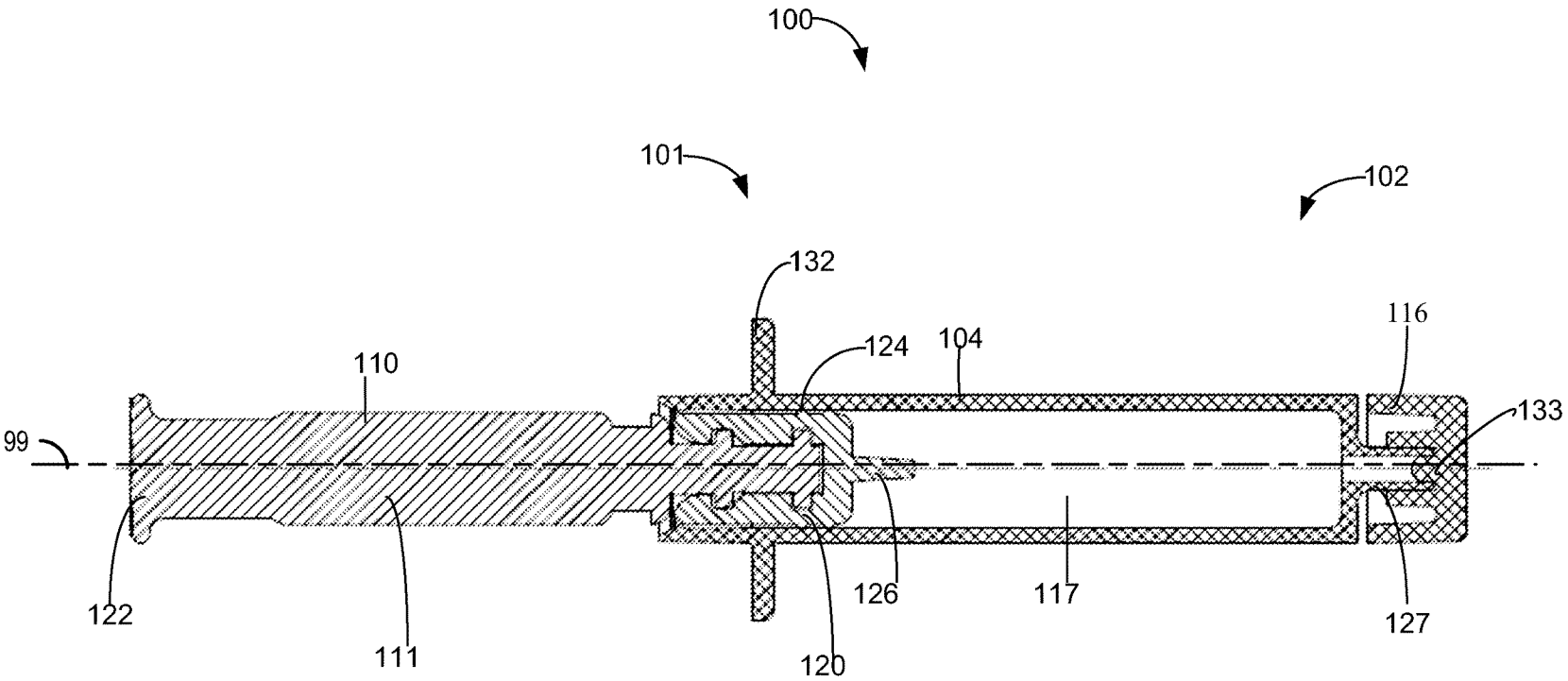
FIG. 22 is a magnified cross sectional view of the device of FIG. 17.

FIGS. 21 and 22 show the device 100 with the plunger top 120 inserted in opening 108 of the housing body 104 and positioned in the proximity of the first actuation end 101 of the device, such that the volume of a liquid reservoir 117 is at its maximum.

Figure 23:
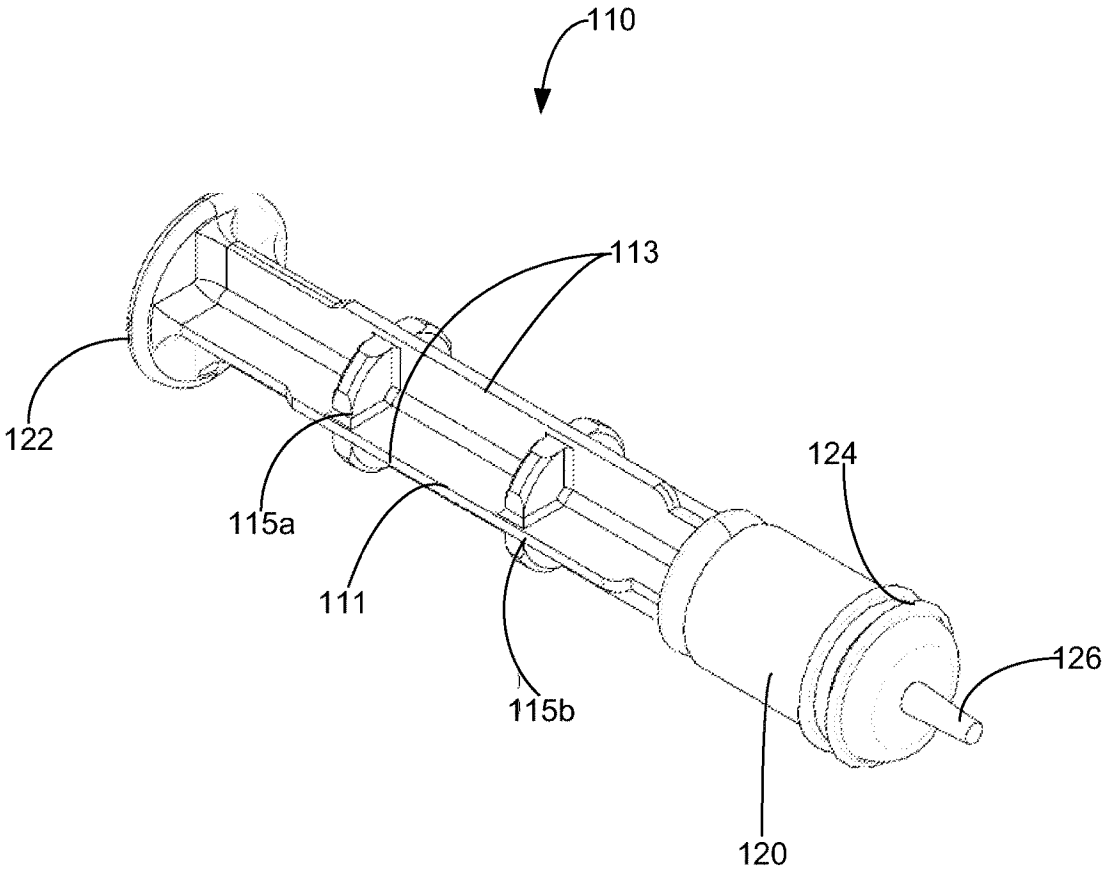
FIG. 23 shows an embodiment of the slidable plunger.
Figure 24A:
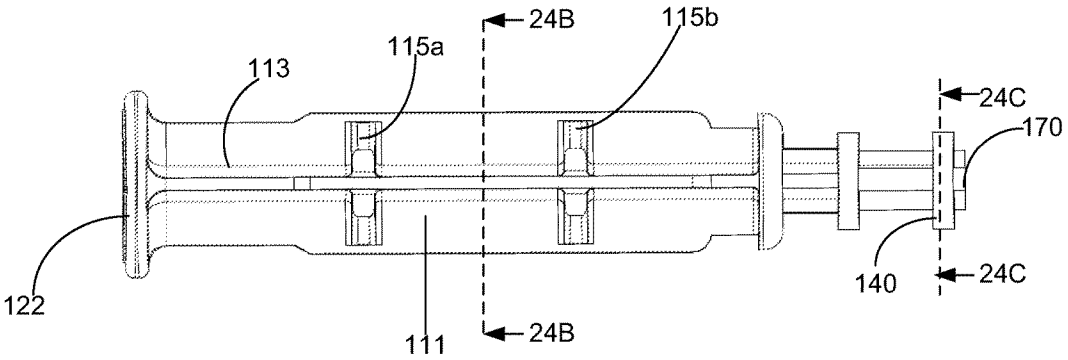
FIG. 24A shows an embodiment of the slidable plunger without the plunger top.

FIG. 23 shows an isolated view of the sliding plunger 110 with the plunger base 122, the plunger rod 111 and the removable plunger top 120. A schematic of the plunger 110 without the plunger top 120 is shown in FIG. 24A. The plurality of longitudinal ridges 113 along with the radially arranged tabs 115*a* and 115*b* on the plunger rod 111 provide structural rigidity to the slideable plunger when actuated into the housing body 104 of the liquid dispensing device 100. The plunger rod 111 is coupled to a plunger rod tip 170. Protrusions 142 and 146 interface with the removable plunger top 120 to secure the plunger rod 111 and the plunger top 120.

Figure 24C:
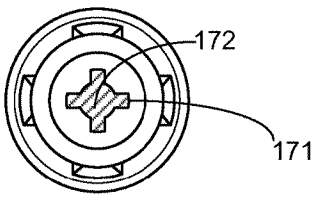
FIG. 24C is a cross sectional view of the plunger rod tip.
Figure 24B:
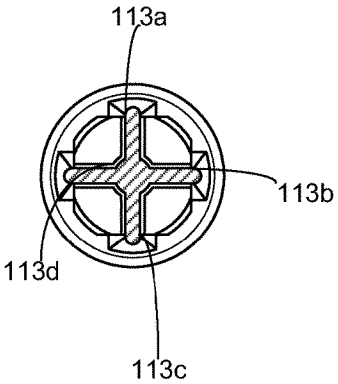
FIG. 24B is a cross sectional view of the plunger rod.

FIG. 24B shows a cross sectional view of the plunger rod 111 taken along section 24B-24B of FIG. 24A. The arrangement of longitudinal ridges 113 (113*a*, 113*b*, 113*c*, 113*d*) is shown in the schematic.

The plunger rod top 170 inserts into the removable plunger top 120 (as shown in FIG. 19). A cross sectional view of the plunger rod top 170 taken along section 24C-24C of FIG. 24A is shown in FIG. 24C. A plurality of radially arranged tabs 171 are shown. The tabs 171 secure a tight fit between the plunger rod top 170 and the plunger top 120. The tabs 171 originate from a common central point hub 172.

It is understood that the dispensing device described and illustrated herein represents only an example embodiment. It is appreciated by those skilled in the art that various changes and additions can be made to such dispensing devices without departing from the spirit and scope of this invention. In one example, the dispensing device may include a threaded rod having a different pitch to depth ratio than described (e.g. larger pitch than depth), having differently spaced/sized threads along the length of the threaded rod, having a left-handed thread, etc. Furthermore, although the dispensing device has been described herein as having a silicone plunger cap, another material (e.g. polymer, elastomer or composition) can be fabricated as the plunger cap instead of silicone that is more flexible than the plunger base.

An example of a dispensing device may comprise a cylindrical housing including a dispensing tip, a movable plunger disposable in the cylindrical housing, the plunger including at least one protrusion configured to be in face-sharing contact with an inner surface of the cylindrical housing along an entirety of dispensing path of the plunger, and a displacement element configured to at least partially extend into the dispensing tip. The displacement element may be positioned on the plunger and may be configured to extend into the dispensing tip when the plunger is in a fully extended position. In one example the plunger may couple with a slidable rod such that the tip of the plunger acts as a displacement element. In another embodiment, the plunger may be coupled to a threaded rod wherein the tip of the threaded rod acts as a displacement element ejecting fluid from the dispensing device.

In one embodiment, an assembly is provided comprising a cylindrical housing holding a plunger therein movable via a twistable base coupled to an internal threaded rod, the twistable base snap fit with the housing, the plunger comprising at least two sections adjacent one another and each engaging threads of the rod, a first portion of the plunger more flexible than a second portion. In yet another embodiment, an assembly is provided comprising a cylindrical housing holding a plunger therein movable via a twistable base coupled to an internal threaded rod, the threaded rod extending into a constricting volume defined by a dispensing tip.

In one embodiment, an assembly is provided comprising a cylindrical housing holding a plunger movable therein and having an internal threaded rod, the rod threads having a larger depth than pitch.

An embodiment for a fluid dispensing device is provided. The fluid dispensing device comprises a cylindrical housing and a movable plunger disposable in the cylindrical housing and a movable rod coupled to the plunger, configured to extend into a dispensing tip of the cylindrical housing. In one example, the plunger comprises a base coupled to a cap, each of the base and cap configured to engage threads of the threaded rod. The cap of the plunger may be more flexible than the base of the plunger. In one example, the cap is coupled to the base via an adhesive material. In another example, the cap is coupled to the base via interlocking complementary contact sharing surfaces. The threaded rod may comprise threads having a larger depth than pitch. The device further includes a removable cap that plugs the dispensing tip when attached to the dispensing tip of the cylindrical housing. The removable cap may be secured to the cylindrical housing body by interlocking grooves and intercepting protrusions between contact sharing surfaces of the removable cap and cylindrical housing body.

An embodiment for a dispensing device comprises a housing having a first, open end and a second, dispensing end, the second end including a dispensing tip with an aperture; a plunger assembly comprising a base coupled to a cap; a threaded rod; and a hand wheel coupled to the threaded rod, the plunger assembly and threaded rod configured to be inserted into the housing via the open end such that the threaded rod extends into the dispensing end.

Another embodiment for a dispensing device comprises a housing having a first, open end and a second, dispensing end, the second end including a dispensing tip with an aperture, a plunger assembly comprising a plunger coupled to a rod, the plunger including a body and a radial protrusion extending outward from the body, the radial protrusion configured to be in face-sharing contact with an inner surface of the housing, the plunger assembly further including a displacement element configured to extend into the dispensing tip in at least one position of the plunger assembly; and a base. In one example the rod coupled to the plunger may be a slidable rod, wherein the base is a finger engaging surface for actuation of the slidable rod. In another embodiment, the plunger may be coupled to a threaded rod, and wherein the base is a twistable hand wheel coupled to the threaded rod. The plunger assembly may comprise of a hollow chamber such that a surface of each hollow chamber is configured to engage with the rod inserted into the hollow chamber.

The plunger may comprise a radial protrusion configured to be in face-sharing contact with an inner surface of the housing. The threaded rod may comprise a cylinder and an external thread wound in a spiral along a length of the cylinder, the cylinder extending beyond a terminal end of the external thread and into the dispensing tip. The external thread may have a pitch that is smaller than a depth of the thread.

In an example, the base and the cap of the plunger assembly each comprise a hollow chamber, a surface of each hollow chamber including an internal thread configured to engage with the external thread of the threaded road when the threaded rod is inserted into the hollow chamber. The dispensing device further comprises a removable cap configured to block the aperture when the removable cap is coupled to the housing.

A further embodiment of a dispensing device comprises a hollow cylindrical housing having a first end and a second end, the second end including a dispensing tip with an aperture, a plunger actuation assembly coupled to the housing and comprising a plunger with a hollow chamber coupled to a rod, the rod coupled to a base, and a removable cap configured to couple to the dispensing tip of the housing. In one example, the rod comprises a dispensing end and a rod portion intermediate the base and the dispensing end, the base positioned outside the housing body, the dispensing end extending into the dispensing tip of the housing. In one example the plunger, rod, and base are coupled together via a snap-fit mechanism. In another example the plunger actuation assembly is coupled to the housing via a snap-fit mechanism. In one embodiment, the plunger is at least partly comprised of silicon.

A further embodiment of a dispensing device comprises a hollow cylindrical housing having a first end and a second end, the second end including a dispensing tip with an aperture; a plunger actuation assembly coupled to the housing, and a removable cap configured to couple to the dispensing tip of the housing. The plunger assembly comprises a plunger including a base coupled to a cap and having a hollow chamber with an internal thread; a threaded rod disposed within the hollow chamber and comprising a cylinder and an external thread wound around the cylinder to engage with the internal thread of the plunger; and a hand wheel coupled to the threaded rod. The cylinder of the threaded rod comprises a base end, a dispensing end, and a threaded portion intermediate the base end and the dispensing end, the base end positioned in a pocket of the hand wheel, the dispensing end extending into the dispensing tip of the housing, wherein the external thread is wound around the threaded portion. In an example, the plunger, threaded rod, and hand wheel are coupled together via a snap-fit mechanism. In an example, the plunger actuation assembly is coupled to the housing via a snap-fit mechanism. The cap of the plunger may include an outer cylindrical surface with a planar face and a radial protrusion in face-sharing contact with an inner surface of the housing. The cap of the plunger may be comprised of silicon and the base of the plunger may be comprised of plastic.

In an embodiment, a method for dispensing fluid from a liquid reservoir comprise advancing a plunger along a threaded rod disposed in a liquid reservoir towards a dispensing tip of the reservoir, and dispensing liquid from the dispensing tip. In one example, the method comprises twisting a hand wheel coupled to the threaded rod in a first direction to advance the plunger. In an example, the method comprises twisting the hand wheel in a second direction opposite the first direction to move the plunger away from the dispensing tip. In another embodiment, a slidable plunger with a rod may be actuated into the housing body of the device by an actuating base coupled to the rod to dispense fluid from the dispensing tip of the dispensing device.

In another embodiment, a sliding plunger rod coupled to a plunger top may be actuated along the housing body with a dispensing tip. The plunger top has a tip insert which inserts into the dispensing tip and acts as a displacement element to remove fluid from the dispensing tip. In another example, a removable cap may be attached to the housing body and secured by flat complementary face sharing surfaces present on the housing body and on the interfacing surface of the removable cap. The removable cap may plug the aperture of the dispensing tip when attached to the device.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A fluid dispensing device, comprising:

a cylindrical housing including a dispensing tip;

a movable plunger disposable in the cylindrical housing, the plunger including at least one protrusion configured to be in face-sharing contact with an inner surface of the cylindrical housing along an entirety of a dispensing path of the plunger; and a displacement element configured to at least partially extend into the dispensing tip, wherein the plunger is coupled to a threaded rod disposable in the cylindrical housing, and wherein the displacement element is a tip of the threaded rod, wherein the plunger comprises a plunger base coupled to a plunger cap, each of the plunger base and the plunger cap configured to engage threads of the threaded rod and be in contact with the inner surface of the cylindrical housing, wherein the plunger cap defines a lower surface of a fluid reservoir of the cylindrical housing, and wherein the plunger cap is more flexible than the plunger base.

2. The device of claim 1, wherein the displacement element is positioned on the plunger and is configured to extend into the dispensing tip when the plunger is in a fully extended position, wherein the fluid reservoir is fluidically coupled with the dispensing tip.

3. The device of claim 1, wherein a removable cap plugs the dispensing tip when attached to the dispensing tip of the cylindrical housing.

4. The device of claim 3, wherein the removable cap is secured to the cylindrical housing by interlocking grooves and intercepting protrusions between contact sharing surfaces of the removable cap and the cylindrical housing.

5. The device of claim 1, wherein the threads of the threaded rod comprise two diametrically opposed, helical flattened surfaces that spirally extend along an axial length of the threaded rod.

6. The device of claim 1, wherein the threaded rod rotates relative to both the plunger cap and the plunger base.

* * * * *